United States Patent [19]

Heigl

[11] Patent Number: 4,746,796

[45] Date of Patent: May 24, 1988

[54] COROTRON WIRE CASSETTE FOR ELECTROPHOTOGRAPHIC PRINTER OR COPIER DEVICES

[75] Inventor: Karl Heigl, Kirchheim, Fed. Rep. of Germany

[73] Assignee: Siemens Aktiengesellschaft, Berlin and Munich, Fed. Rep. of Germany

[21] Appl. No.: 920,711

[22] Filed: Oct. 20, 1986

[30] Foreign Application Priority Data

Nov. 25, 1985 [DE] Fed. Rep. of Germany ..... 3541592

[51] Int. Cl.[4] ..... H01T 19/00

[52] U.S. Cl. ..... 250/324; 361/229; 361/230; 355/3 CH

[58] Field of Search ..... 361/229, 230; 250/324, 250/325, 326; 355/3 CH

[56] References Cited

U.S. PATENT DOCUMENTS

| | | | |
|---|---|---|---|
| 2,856,533 | 10/1958 | Rosenthal . | |
| 3,499,143 | 3/1970 | Martin . | |
| 3,578,970 | 5/1971 | Michaud, et al. | 250/325 |
| 3,634,077 | 1/1972 | Sullivan . | |
| 3,840,744 | 10/1974 | Hedman, Jr. . | |
| 3,842,273 | 10/1974 | Van Buskirk . | |
| 3,965,400 | 6/1976 | Tolliver . | |
| 4,038,546 | 7/1977 | Jasinski | 250/324 |
| 4,142,269 | 3/1979 | Seeberger . | |

FOREIGN PATENT DOCUMENTS

| | | | |
|---|---|---|---|
| 0151865 | 8/1985 | European Pat. Off. | 250/324 |

*Primary Examiner*—Carolyn E. Fields
*Assistant Examiner*—John A. Miller
*Attorney, Agent, or Firm*—Hill, Van Santen, Steadman & Simpson

[57] ABSTRACT

A corotron wire cassette including a supply reel seated therein for the acceptance of a wire-shaped electrode is interchangeably provided in a corona-generating means of an electrophotographic printer or copier device. The supply reel in the corotron wire cassette includes a restoring spring. The wire-shaped electrode is conducted via a deflection roller comprising felt rings secured thereon for cleaning the wire-shaped electrode. Connected to the wire-shaped electrode, a coupling clip is provided at the output of the corotron wire cassette, this coupling clip cooperating, in the inserted condition of the corotron wire cassette, with a holding element of a cleaning slide of the corona-generating means. Via an electro-motive means, a control device automatically pulls the wire-shaped electrode out of the cassette in accord with the preset paper width after the cassette is inserted. When a cleaning procedure is initiated, the cleaning slide is moved back and forth in its guide channel via the electro-motive means.

20 Claims, 2 Drawing Sheets

COROTRON WIRE CASSETTE FOR ELECTROPHOTOGRAPHIC PRINTER OR COPIER DEVICES

BACKGROUND OF THE INVENTION

1. Field of the Invention

The invention relates to a corona-generating device for electrophotographic printer or copier devices including a wire shaped electrode arranged at a distance from a photoconductor.

2. Description of the Prior Art

Corona-generating devices are utilized for numerous purposes in electrophotographic printer or copier devices. For example, for charging the photoconductor, for transferring a developing image onto the continuous web paper in the transfer station, for removing background particles from a developed, latent electrostatic image and for cleaning the photoconductor drum by neutralizing the charge on the remaining toner particles.

As may be derived from U.S. Pat. No. 2,856,533 or from German No. OS 2 424 835, such corona-generating devices are generally composed of at least one wire-shaped electrode, what is referred to as the corotron wire, which is surrounded by a shielding.

Although these corona-generating devices are capable of effecting a uniform electrostatic charge on the surface provided therefore, dust particles, toner particles or other particles can collect on or around the corotron wire and its shielding and can produce a non-uniform generation of the corona current along the length of the corotron wire. With this in mind, German No. OS 24 24 835 discloses that cleaning apparatus be provided in corona-generating devices.

It is also standard to engage the corotron wire extending over the full length of an intermediate carrier (photoconductive drum) at stationary end points. The corotron wire in the transfer station stretched freely over the photoconductive drum when printing paper sheets which are narrower than the photoconductor contaminates and damages the coatings of the photoconductor in those regions not covered by paper.

SUMMARY OF THE INVENTION

An object of the invention is to fashion a corona-generating means of the type described above such that, first, the wire-shaped electrode can be easily replaced and, second, an easy cleaning of the corona-generating means is possible.

Further, the wire-shaped electrode should be variably adjustable in length.

In a corona-generating means of the type described, this object is achieved by an apparatus embodying the principles of the present invention.

On the basis of the provision of a corona-wire cassette secured interchangeably in a cassette receptacle of the device, the corotron wire being wound on a supply reel in this corotron wire cassette, the corotron wire can be easily changed via the cassette when it is worn without the wire having to be touched for this purpose. In order, first, to manage a pre-stress of the wire-shaped upper electrodes and, second, to be able to easily wind up a used electrode, the supply reel in the corotron wire cassette is connected to a spring element which, for example, can be a coil spring.

In order to be able to match the wire-shaped electrode to various paper widths in terms of its length, an electro-motively operated adjustment device is provided in the corona-generating means, this seizing the end of the wire-shaped electrode at the cassette via a holding element and drawing it out of the cassette dependent on the paper width to be processed.

In an advantageous embodiment of the invention, the holding element can be part of the cleaning element, for example, a stripper element, which serves the purpose of cleaning that region of the corona-generating means which accepts the wire-shaped electrode. To this end, an electro-motive device moves a cleaning slide back and forth with the wire-shaped electrode of the corona-generating means suspended therein.

In this back and forth motion, the wire-shaped electrode is conducted through a cleaning device, in the form of two felt rings, which is arranged in the corotron wire cassette. Both a cleaning of the corotron wire as well as its adjustment to various lengths, and a cleaning of the acceptance region of the corotron wire of the corona-generating means, are thus possible via a single electro-motive device. In view of maintenance and serviceability, the overall corona-generating means is thereby especially simple in effect, this significantly increasing the overall service-friendliness and operability of the electrophotographic printer or copier device.

BRIEF DESCRIPTION OF THE DRAWINGS

An embodiment of the invention is shown in the drawings and shall be set forth in greater detail below by way of example. Shown therein are.

DESCRIPTION OF THE PREFERRED EMBODIMENTS

Figure 2:
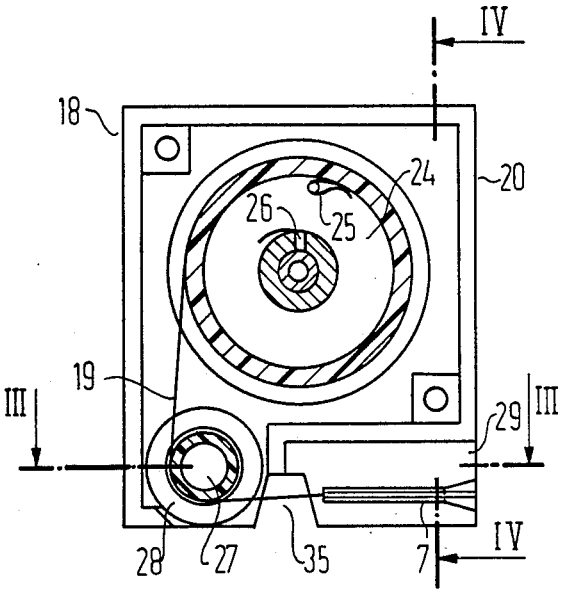
FIG. 2 is an illustration of the cortron wire cassette in its opened condition shown partially in section.
Figure 3:
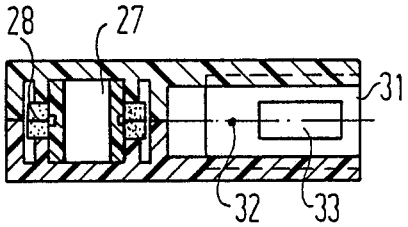
FIG. 3 is a sectional view of the corotron wire cassette along the section line III—III of FIG. 2.

A corona-generating means is provided in the transfer station of a printer device functioning on the principle of electro-photography as disclosed, for example, in U.S. Pat. No. 3,634,077. The corona-generating means extends along a photoconductive drum 10. It is composed of a pivotably executed frame 11 comprising a guide channel 12 fashioned therein for the acceptance of a cleaning slide 13 which can be moved in the guide channel 12 via rope pulleys 16, being moved with the assistance of a motor device composed of a geared motor 14 with appertaining sensing means 15. A rope 17 is stretched over the rope pulleys 16, the one part of this rope being secured to the cleaning slide 13. An interchangeably fashioned corotron wire cassette 18 is latched at one side of the frame 11, this cassette 18 accepting a wire-shaped electrode (corotron wire) 19 (FIG. 2) of the corona-generating means.

The corotron wire cassette is composed of a plastic housing 20 which can be glued together from two half shells. A supply reel 21 for the acceptance of the wire-shaped electrode 19 composed of tungsten wire having a diameter of about 0.08 mm is rotatably secured in the plastic housing 20. The reel 21 has a lateral incision 22 by which the beginning of the trungsten wire is conducted out of the reel and is fixed on the supply reel 21 via a screw 23. A helical restoring spring 24 is built into the supply reel 21, this restoring spring 24 having its one end 25 secured to the supply reel 21 and having its other end 26 secured, for example via a clamp member, to a set-off of the housing 20, which, for example, can also serve as hub for the acceptance of the rotational axis of the supply reel 21. A deflection roller 27 for the wire-shaped electrode is rotatably secured under the supply reel 21 in one corner of the plastic housing 20 of the corotron wire cassette. Two felt rings 28 between which the wire-shaped electrode is conducted are arranged on the deflection roller 27.

Guides 30 for the acceptance of a coupling clip or suspension clip 31 are provided in a recess 29 in the lower part of the corotron wire cassette 18. The coupling clip rigidly connected to the corotron wire via a fastening point 32 is freely guided in the guides 30 and includes an acceptance opening 33 for the acceptance of a holding element 34 of the cleaning slide 13 fashioned as a latch element. A recess 35 through which the corotron wire 19 passes and which is provided for the acceptance of a wiper contact 36 contacting the corotron wire 19 is further situated between the recess 29 and that part of the corotron wire cassette accepting the deflection roller 27.

A control device 37 is provided for controlling the movement of the cleaning slide 13 and, thus, for withdrawing the corotron wire 19 from the corotron wire cassette 18, this control device 37 being in interactive engagement with the sensing means 15 and with the geared motor 14. The control means 37 contains an actual input means 38. This input means, for example, can be a rotary knob or a digital keyboard by which the width of the paper to be processed is input. Dependent on the width of the paper to be input, the wire-shaped electrode 19 is then withdrawn from the corotron wire cassette 18. To this end, the desired width of the paper which has been input and, thus, the withdrawal length of the corotron wire 19 is compared in a comparison means 39 to the actual withdrawal length of the corotron wire 19 and, thus, to the position of the cleaning slide 13 derived from the sensor means 15, and the geared motor 14 designed, for example as a stepping motor, is driven therewith. Instead of the direct input via the input means 38, it is also possible to combine the input means 38 with the paper width adjustment means such that corresponding signals are automatically conducted to the input device 38 when the paper width is set.

Figure 1:
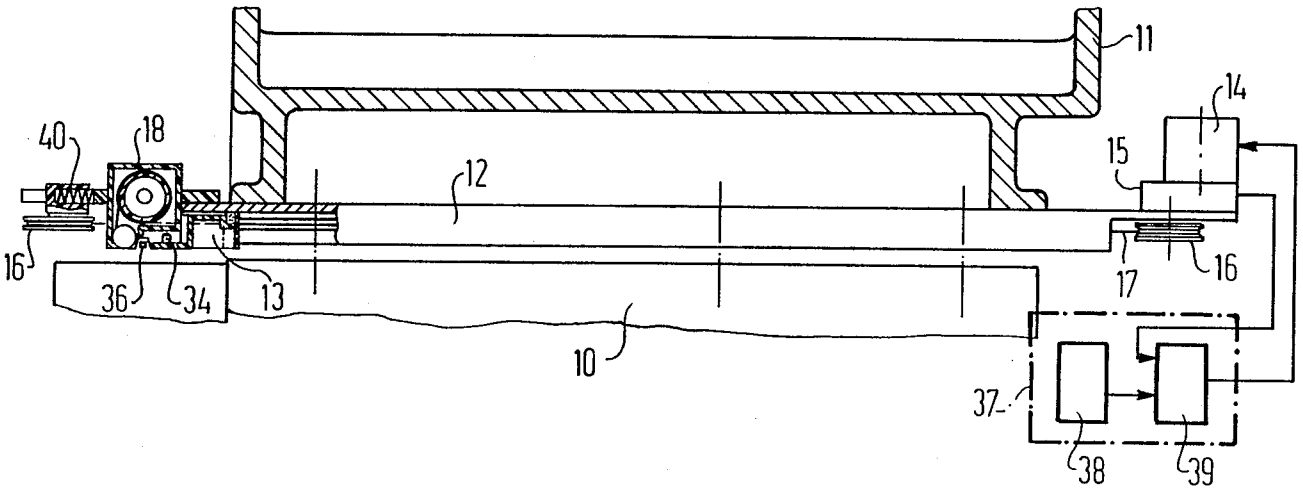
FIG. 1 is a schematic illustration of the corona-generating means in a transfer station of a non-mechanical printer device comprising an automatic adjustment device for setting the length of the corotron wire.
Figure 4:
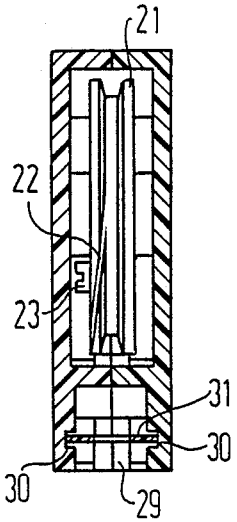
FIG. 4 is a sectional view of the corotron wire cassette along the section line of IV—IV of FIG. 2.

For the operation of such a corona-generating means, the corotron wire cassette 18 is first inserted into, for example, a resiliently fashioned cassette receptacle 40 of the frame 11, being inserted until it latches in the cassette receptacle 40. The cleaning slide 13 is thereby situated in the left-hand stop position of FIG. 1. The retaining nose of the holding element 34 engages into the acceptance opening 33 of the coupling clip 31 of the corotron wire cassette 18. At the same time, the corotron wire 19 is contacted via the wipe contact 36 and is charged with the appropriate corona voltage as needed.

In accord with the paper width set via the control arrangement 37, the corotron wire 19 is then drawn out of the corotron wire cassette 18 against the force of the restoring spring 24, being drawn out by the cleaning slide 13.

In a cleaning procedure which can be initiated by the control device 37, the cleaning side 13 is moved back and forth over the length of the guide channel for cleaning the corotron wire 19 and for cleaning the guide channel 12 (transfer rail). During this back and forth motion, the cleaning of the corotron wire 19 ensues by means of the two felt rings 28 between which the corotron wire 19 is moved. When the corotron wire 19 is used up and the corotron wire cassette 18 is to be replaced for that reason, the cleaning slide 13 is again moved into its idle position at the left stop of the guide channel 12. The corotron cassette 18 is, thus, unlocked and it can be removed from the cassette receptacle 40 in a simple way for replacement.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A corona-generating means for an electrophotographic printer device comprising:

a cassette releasably secured in a fixed position in a cassette receptacle of the printer device, a corotron wire electrode retractably mounted in said cassette, and said electrode including end means for selectively engaging with a movable means in said printer device wherein said electrode is withdrawable from said cassette into a work position, and retractable into said cassette for selective replacement of said cassette.

2. A corona-generating means according to claim 1, wherein a supply reel accepting said electrode is mounted in said cassette, said supply reel cooperating with a restoring means automatically winding up the electrode.

3. A corona-generating means according to claim 2, wherein said restoring means comprises a spring element attaching at said supply reel as a mechanical energy storage device.

4. A corona-generating means according to claim 1, wherein said cassette includes a cleaning device for said electrode.

5. A corona-generating means according to claim 1, wherein said electrode is led over a deflection roller comprising a cleaning felt.

6. A corona-generating means according to claim 4, wherein said electrode is conducted between two felt rings which form at least a part of said cleaning device.

7. A corona-generating means according to claim 1, wherein said cassette includes an open recess exposing a portion of said electrode, said recess being in alignment with a wiper contact of the printer device to permit said contact to contact said electrode.

8. A corona-generating means according to claim 13, wherein said cassette is manufactured of an electrically insulating material.

9. A corona-generating means according to claim 1, wherein said corona-generating means includes an adjustment means connected to said movable means which enables said electrode to be withdrawn from said cassette to a prescribed length dependent on a width of paper to be processed.

10. A corona-generating means according to claim 9, wherein said adjustment means comprises an electromotive drive means connected to said movable means.

11. A corona-generating means according to claim 10, wherein said movable means is mounted on a cleaning element movable via said electro-motive drive means through a region of the corona means which accepts said electrode.

12. A corona-generating means according to claim 10, wherein said end means of said elctrode is connected to a coupling clip for the acceptance of said movable means, said coupling clip being seated withdrawable from said cassette.

13. A corona-generating means for an electrophotographic printer device comprising:

a cassette to be releasably secured in a cassette receptacle of the printer device, a corotron wire electrode mounted in said cassette with a coupling means secured at a free end of said electrode and normally positioned in a guide portion of said cassette by means of which said electrode is withdrawable from said cassette into a work position and retractable into said cassette for selective replacement of said cassette.

14. A corona-generating means according to claim 13, wherein a supply reel accepting said electrode is mounted in said cassette, said supply reel cooperating with a restoring means automatically winding up the electrode.

15. A corona-generating means according to claim 14, wherein said restoring means comprises a spring element attaching at said supply reel as a mechanical energy storage device.

16. A corona-generating means according to claim 13, whererin said cassette includes a cleaning device from said electrode.

17. A corona-generating means according to claim 13, wherein said electrode is led over a deflection roller comprising a cleaning felt.

18. A corona-generating means according to claim 16, wherein said electrode is conducted between two felt rings which form at least a part of said cleaning device.

19. A corona-generating means according to claim 13, wherein said cassette includes an open recess exposing a portion of said electrode to permit a wipe contact of said printer device to contact said electrode.

20. A corona-generating means according to claim 13, wherein said cassette is manufactured of an electrically insulating material.

* * * * *